US010962901B2

(12) United States Patent
Makinodan et al.

(10) Patent No.: US 10,962,901 B2
(45) Date of Patent: Mar. 30, 2021

(54) IMAGE FORMING APPARATUS AND CONTROL METHOD OF IMAGE FORMING APPARATUS

(71) Applicant: CANON KABUSHIKI KAISHA, Tokyo (JP)

(72) Inventors: Jiro Makinodan, Kashiwa (JP); Mizuho Ueshima, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/678,297

(22) Filed: Nov. 8, 2019

(65) Prior Publication Data

US 2020/0150559 A1 May 14, 2020

(30) Foreign Application Priority Data

Nov. 9, 2018 (JP) ..... JP2018-211212

(51) Int. Cl.
*G03G 15/08* (2006.01)

(52) U.S. Cl.
CPC ..... *G03G 15/0856* (2013.01)

(58) Field of Classification Search
CPC ..... G03G 15/0856; G03G 15/0831; G03G 15/556; G03G 15/553; G03G 2215/0888
See application file for complete search history.

(56) References Cited

U.S. PATENT DOCUMENTS

| | | | | |
|---|---|---|---|---|
| 8,897,658 | B2 | 11/2014 | Kendall | |
| 2001/0043259 | A1* | 11/2001 | Ogata | G03G 15/0856 347/140 |
| 2010/0202788 | A1* | 8/2010 | Suda | G03G 15/0863 399/27 |
| 2010/0232816 | A1* | 9/2010 | Tan | G03G 15/0856 399/27 |
| 2016/0033895 | A1* | 2/2016 | Noda | G03G 15/0865 399/12 |
| 2017/0139347 | A1* | 5/2017 | Nakase | G03G 15/2039 |
| 2019/0171133 | A1* | 6/2019 | Hayashi | G03G 15/556 |

FOREIGN PATENT DOCUMENTS

KR 20080073476 A * 8/2008

* cited by examiner

*Primary Examiner* — Francis C Gray
(74) *Attorney, Agent, or Firm* — Venable LLP

(57) ABSTRACT

An image forming apparatus includes an image forming unit configured to form an image by using a toner based on image data; a detector configured to detect the toner in the image forming unit; a mount portion to which a container containing the toner is mounted; and a controller configured to perform a supply control for supplying the toner from the container mounted to the mount portion, based on a detection result of the detector; determine a usage condition of the container mounted to the mount portion; determine an amount of the toner supplied from the container in the supply control, based on a determination result of the usage condition and the image data; cumulate the amount of the toner supplied from the container in the supply control; and determine a remaining amount of the toner in the container mounted to the mount, based on a cumulated amount.

14 Claims, 8 Drawing Sheets

IMAGE FORMING APPARATUS AND CONTROL METHOD OF IMAGE FORMING APPARATUS

BACKGROUND OF THE INVENTION

Field of the Invention

The present invention relates to a technology of determining the amount of a toner remaining in a container.

Description of the Related Art

A toner bottle containing a toner to be supplied to a developing apparatus is detachably attached to image forming apparatuses, such as a copying machine and a laser beam printer, that form an image on a recording medium with a two-ingredient developer including the toner and a carrier. In order to avoid the circumstance where a user cannot obtain a printed product since the toner is run out in the developing apparatus, a toner remaining amount sensor that detects the amount of the toner remaining in the toner bottle (hereinafter referred to as the toner remaining amount) is provided in the toner bottle. When it is determined that the toner remaining amount is low based on the detection result of the toner remaining amount sensor, an image forming apparatus informs a user that the toner remaining amount is low, and outputs a signal requiring delivery of a new toner bottle to a managing server. Although the toner remaining amount in the toner bottle can be accurately detected with the toner remaining amount sensor provided in the toner bottle, the toner remaining amount sensor leads to an increase in the cost of the toner bottle. Therefore, a toner remaining amount estimation unit has been proposed that estimates the toner remaining amount based on information obtained from the usage conditions and the usage environment of an image forming apparatus without providing the toner remaining amount sensor.

Conventionally, the following two have been mainly proposed as the toner remaining amount estimation unit. One is a toner remaining amount estimation unit that counts the number of times of toner supply based on the cumulative number of rotations of a toner supply motor, and estimates the toner remaining amount based on the counted number of times of toner supply. The other is a toner remaining amount estimation unit that estimates a toner consumption amount in a developing apparatus from a video count value obtained from image information for which printing is performed, and estimates the toner remaining amount based on the estimated toner consumption amount. However, the above-described two toner remaining amount estimation units have a problem for correctly estimating the toner remaining amount. The toner remaining amount estimation unit that estimates the toner remaining amount based on the counted number of times of toner supply estimates the toner remaining amount by setting a constant value for the toner supply amount for each single time of supply operation, and estimating the supplied total toner amount. Therefore, the estimation of the correct toner remaining amount may not be able to be performed in the period when the toner remaining amount is decreased and a toner discharge amount becomes unstable. Additionally, the toner remaining amount estimation unit that estimates the toner remaining amount based on the toner consumption amount obtained from the video count value uses the toner consumption amount corresponding to the video count value, irrespective of the change in a surrounding environment, and the variation in each apparatus. Therefore, the toner amount actually used for development may be changed according to the change in the surrounding environment and the variation in each apparatus, an error may occur in the estimated toner consumption amount and the actual toner consumption amount, and the estimation of the correct toner remaining amount may not be able to be performed.

In order to solve these problems, the specification of U.S. Pat. No. 8,897,658 discloses a method of estimating the toner remaining amount with an estimate formula including a correction term updated when a toner bottle becomes empty in a toner remaining amount estimation unit that estimates the toner remaining amount based on a video count value. The estimated period until the toner bottle becomes empty based on the previous video count value for the toner bottle, and the period until the toner bottle actually becomes empty are reflected on the correction term. In this manner, the specification of U.S. Pat. No. 8,897,658 enables to reduce the error between the toner consumption amount estimated by the estimate formula using the reflected correction term, and the actual toner consumption amount.

However, in the method disclosed by the specification of U.S. Pat. No. 8,897,658, since the correction term is calculated in the unit of one toner bottle, the use progress state of one toner bottle will be uniformly calculated by the estimate formula using the correction term calculated in the unit of one bottle. Therefore, similar to the case of the toner remaining amount estimation unit based on the cumulative number of rotations of the toner supply motor, the correct estimation of the toner remaining amount may not be able to be performed in the period when the toner remaining amount is decreased, and the toner discharge amount becomes unstable. Additionally, the discharge amount of the toner discharged from the toner bottle in an initial stage when the use of the toner bottle is started is unstable. Especially, in the case of a toner bottle having the configuration with which a toner cannot be easily discharged from the toner bottle in toner supply operations several times since the use of the toner bottle is started, the prediction accuracy of the toner remaining amount is decreased. When the error of the toner remaining amount in the initial stage when the use of the toner bottle is started, and the error of the toner remaining amount in the state where the toner remaining amount is decreased are piled up, as a result, it becomes difficult to correctly estimate the toner remaining amount.

SUMMARY OF THE INVENTION

Therefore, the present invention has been made in view of the above-described problems, and provides an image forming apparatus that determines the remaining amount of a developer in a container from image data based on a determination condition corresponding to the number of times of supply operation.

An image forming apparatus according to an embodiment of the present invention comprises: an image forming unit configured to form an image by using a toner based on image data; a detector configured to detect the toner in the image forming unit; a mount to which a container containing a supply toner is mounted; and a controller configured to: perform a supply control for supplying the supply toner from the container mounted to the mount, based on a detection result of the detector; determine a usage condition of the container mounted to the mount; determine an amount of the supply toner supplied from the container in the supply control, based on a determination result of the usage condition and the image data; cumulate the amount of the supply toner supplied from the container in the supply control; and determine a remaining amount of the supply toner in the container mounted to the mount, based on a cumulated amount.

Further features of the present invention will become apparent from the following description of exemplary embodiments with reference to the attached drawings.

DESCRIPTION OF THE EMBODIMENTS

The embodiments of the present invention will now be described with reference to the accompanying drawings.

Embodiment 1

(Image Forming Apparatus)

Figure 1:
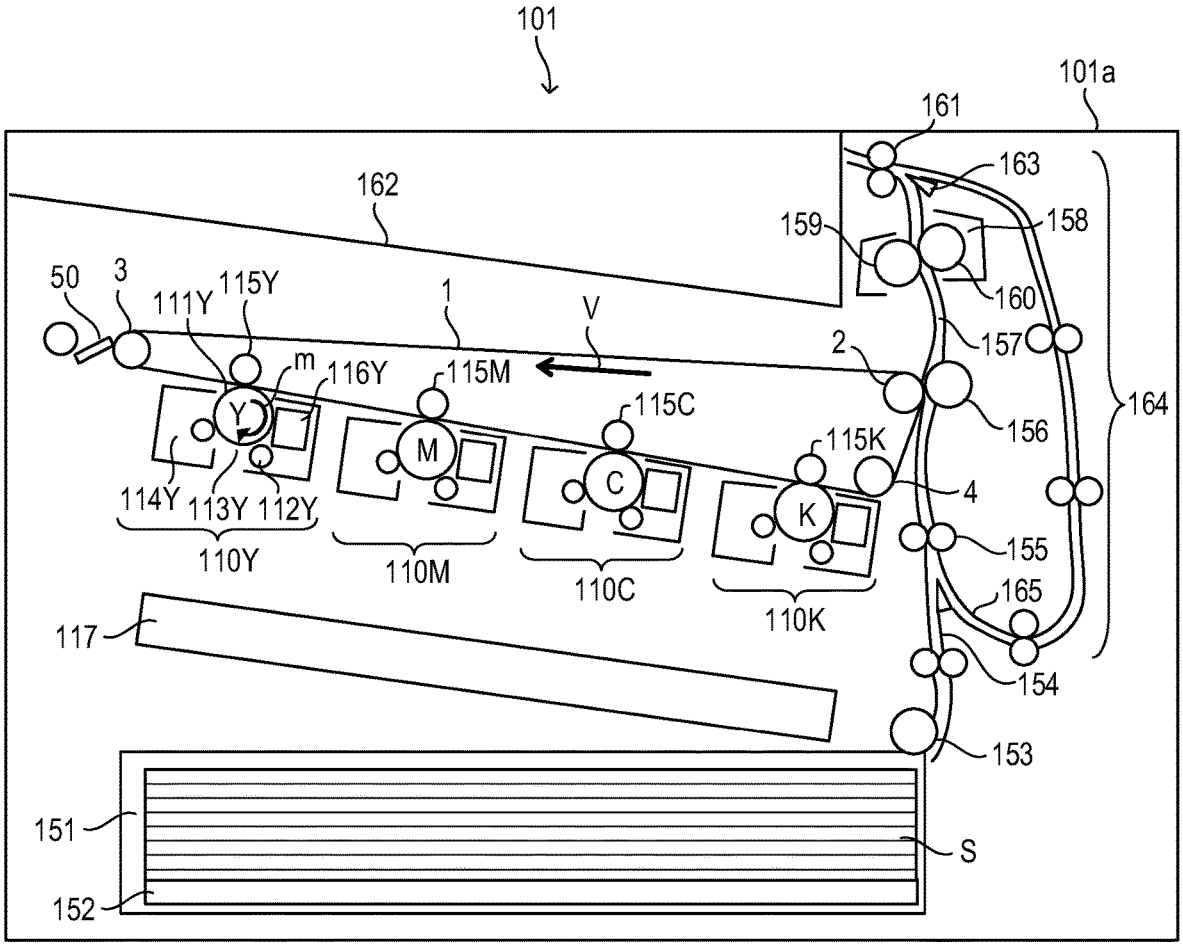
FIG. 1 is a cross-sectional view of an image forming apparatus.

An image forming apparatus 101 is, for example, a copying machine, a fax machine, a printer, or a multifunction machine including some of the functions of these machines. In the present embodiment, a color image forming apparatus 101 using the electrophotography system will be described by using FIG. 1. FIG. 1 is a cross-sectional view of the image forming apparatus 101. The image forming apparatus 101 forms a color image on a recording medium with toners of a plurality of colors by using the electrophotography system. However, the image forming apparatus 101 is not limited to the image forming apparatus that forms color images, but may be an image forming apparatus that forms monochrome images. The image forming apparatus 101 is a so-called intermediate transfer tandem system in which image forming portions 110Y, 110M, 110C and 110K of 4 colors are arranged side by side along an intermediate transfer body (hereinafter referred to as the intermediate transfer belt) 1, which is a belt member. The subscripts Y, M, C and K of the reference numerals represent yellow, magenta, cyan and black, respectively. In the following description, the subscripts Y, M, C and K of the reference numerals may be omitted when not particularly necessary.

The intermediate transfer belt 1 is stretched by a secondary transfer inner driving roller (first secondary transfer member) 2 as a driving member, a tension roller 3 that gives a predetermined tension to the intermediate transfer belt 1, and a secondary pre-transfer roller 4 as a stretch member. Note that the number of rollers over which the intermediate transfer belt 1 is stretched is not limited to three, and may be two or four or more. The intermediate transfer belt 1 is a belt member rotated in the direction of an arrow V in FIG. 1. Primary transfer rollers 115Y, 115M, 115C, and 115K as primary transfer member that makes the intermediate transfer belt 1 contact photosensitive members 111Y, 111M, 111C, and 111K, respectively, are arranged between the tension roller 3 and the secondary pre-transfer roller 4.

The tension roller 3 provides tension to the intermediate transfer belt 1. The outer periphery portion of the secondary transfer inner driving roller 2 is formed by conductive EPDM (ethylene propylene diene rubber), so that the secondary transfer inner driving roller 2 rotates the intermediate transfer belt 1 with a frictional force in a state where tension is provided by the tension roller 3 to the intermediate transfer belt 1. The initial friction resistance μ of an outer periphery surface of the secondary transfer inner driving roller 2 is set to about 1.0 to 1.5. Note that the material of the secondary transfer inner driving roller 2 and the initial friction resistance of the outer periphery surface are not limited to them. An intermediate transfer belt cleaner 50 is fixedly arranged to oppose to the tension roller 3 with the intermediate transfer belt 1 being sandwiched between the intermediate transfer belt cleaner 50 and the tension roller 3. The intermediate transfer belt cleaner 50 removes the toner remaining on the intermediate transfer belt 1 after secondary transfer.

A toner image formed by the image forming portion 110 is transferred via the intermediate transfer belt 1 to a recording medium (hereinafter referred to as the recording material) S to be conveyed, and an image is formed on the recording material S. The recording material S is a transfer material on which an image is formed by the electrophotography system, and is, for example, paper, an OHP sheet, cloth, etc. The image formation to the recording material S by the image forming apparatus 101 will be described below.

<Conveying Process of Recording Material>

The recording material S is stacked on a lift-up apparatus 152 in a recording material containing portion 151. The recording material S is fed from the recording material containing portion 151 by a feeding roller 153 according to image formation timing. The recording material S may be fed by other feeding systems. The recording material S fed by the feeding roller 153 passes through a feeding passage 154, and is conveyed to registration rollers 155. After the skew and conveying timing of the recording material S are corrected by the registration rollers 155, the recording material S is conveyed to a secondary transfer portion. The secondary transfer portion is a transfer nip portion formed by the secondary transfer inner driving roller 2, and a secondary transfer outer roller (second secondary transfer member) 156 arranged to oppose to the secondary transfer inner driving roller 2. The toner image on the intermediate transfer belt 1 is transferred onto the recording material S by providing predetermined pressurizing force and electrostatic load bias to the secondary transfer portion.

<Image Forming Process>

First, an image forming process until the toner image formed on the intermediate transfer belt is conveyed to the secondary transfer portion according to the timing at which the recording material S is conveyed to the secondary transfer portion by the above-described conveying process will be described. The image forming portion 110Y forms a toner image with a toner of yellow (Y). The image forming portion 110M forms a toner image with a toner of magenta (M). The image forming portion 110C forms a toner image with a toner of cyan (C). The image forming portion 110K forms a toner image with a toner of black (K). Since the image forming portion 110Y, the image forming portion 110M, the image forming portion 110C, and the image forming portion 110K have the same configurations except that the colors of the toners are different, the image forming process by the image forming portion 110Y will be described below.

Figure 2:
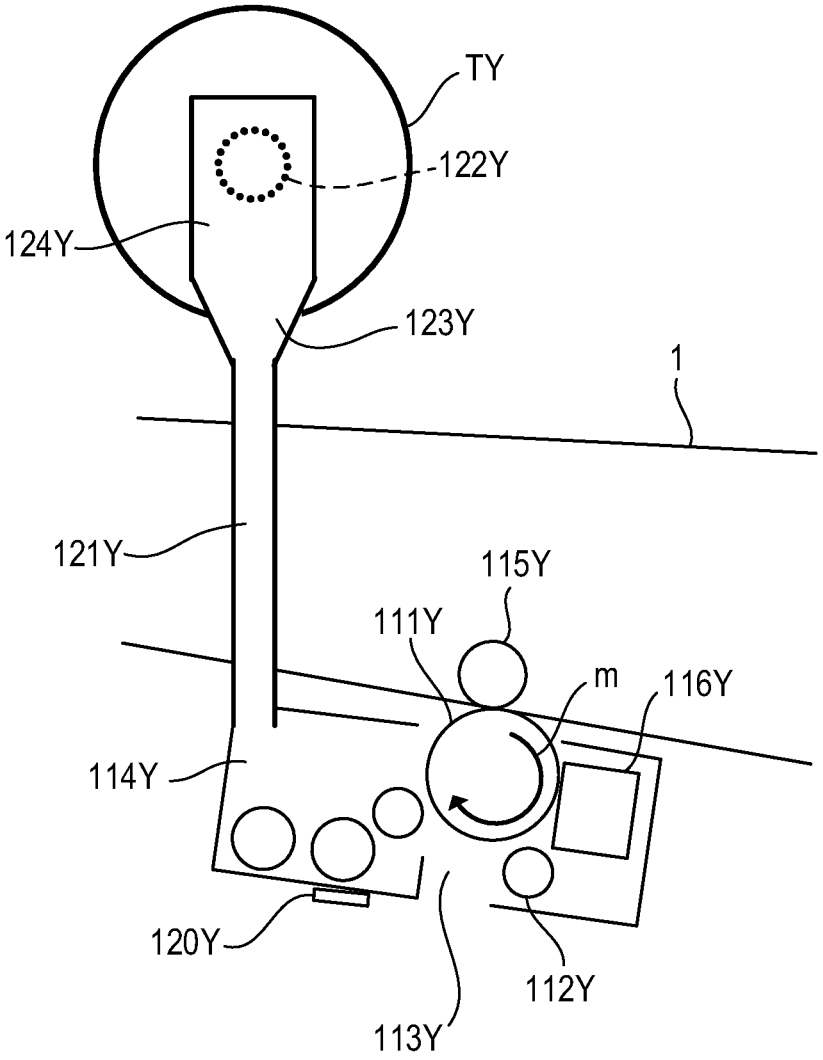
FIG. 2 is a cross-sectional view of an image forming portion.

FIG. 2 is a cross-sectional view of the image forming portion 110Y. The image forming portion 110Y as a toner image forming unit includes a photosensitive member 111Y as an image carrier, a charging device 112Y, an exposure portion 113Y, developing apparatus 114Y, the primary transfer roller 115Y, and a photosensitive member cleaner 116Y Under the image forming portion 110Y, a scanner unit 117 as a laser exposure apparatus is arranged. The scanner unit 117 includes a laser light source, a polygon mirror, a correction system lens, and a reflective mirror. The photosensitive member 111Y is rotated in the direction of an arrow m in FIG. 2. The charging device 112Y uniformly charges the surface of the photosensitive member 111Y. The scanner unit 117 emits a laser light modulated according to an image signal. The laser light passes through an exposure portion 113Y, exposes the uniformly charged surface of the photosensitive member 111*y*, and forms an electrostatic latent image. The charging device 112Y and the exposure portion 113Y function as a latent image formation unit that forms an electrostatic latent image corresponding to an image of yellow on the photosensitive member 111Y. The electrostatic latent image formed on the photosensitive member 111Y is developed with the toner of yellow (Y) by the developing apparatus 114Y, and a toner image is formed on the photosensitive member 111Y. The developing apparatus 114Y functions as a development unit that develops the electrostatic latent image on the photosensitive member 111Y by using the toner of yellow. The toner image of yellow (Y) is transferred onto the intermediate transfer belt 1 by the predetermined pressurizing force and electrostatic load bias that are given by the primary transfer roller 115Y The toner remaining on the photosensitive member 111Y after primarily transfer is collected by the photosensitive member cleaner 116Y.

The image forming processes of respective colors processed in parallel by the image forming portions 110Y, 110M, 110C, and 110K are performed at the timings with which the toner image of an upper stream color primarily transferred onto the intermediate transfer belt 1 is superimposed. Specifically, similar to the image forming portion 110Y that forms the toner image of yellow, the image forming portion 110M forms a toner image of magenta, and transfers the toner image of magenta on the toner image of yellow that has been transferred onto the intermediate transfer belt 1 in a superimposed manner. Additionally, the toner image of cyan formed by the image forming portion 110C is transferred on the toner image of magenta that has been transferred onto the intermediate transfer belt 1. Further, the toner image of black formed by the image forming portion 110K is transferred on the toner image of cyan that has been transferred onto the intermediate transfer belt 1. In this manner, the toner images of the four different colors are sequentially transferred onto the intermediate transfer belt 1 in a superimposed manner. The superimposed toner images of the four colors are conveyed to the secondary transfer portion. Note that, although the number of colors in the present embodiment is four, the number of colors is not limited to four, and the arrangement order of colors is not limited to this, either.

Next, the image forming process after the secondary transfer portion will be described. In the secondary transfer portion, the toner images of the four colors transferred onto the intermediate transfer belt 1 are collectively transferred onto the recording material S. The recording material S is conveyed to a fixing apparatus 158 through a pre-fixing conveyance path 157. The fixing apparatus 158 includes a fixing roller 159 provided inside with a heater serving as a heat source, and a pressure roller 160 urged toward the fixing roller 159. The toner images are fixed onto the recording material S by providing predetermined pressurizing force and quantity of heat to the recording material S within a fixation nip that is formed by the fixing roller 159 and the pressure roller 160, and a full color image is formed on the recording material S. The recording material S on which the full color image has been formed is conveyed from the fixing apparatus 158 to discharge reverse rollers 161. In the case of single side printing, the recording material S is discharged onto a discharging tray 162 by the normal rotation of the discharge reverse rollers 161. In the case of double-side printing, a switch back operation of the recording material S is performed by the reverse rotation of the discharge reverse rollers 161, so as to reverse the front end and the rear end of the recording material S, and the recording material S is conveyed to a double-sided conveying apparatus 164 by a diverging apparatus 163. The double-sided conveying apparatus 164 conveys the recording material S from a re-feeding passage 165 to the feeding passage 154 in consideration of the timing of the subsequent recording material that is fed by the feeding roller 153. The recording material S is conveyed again to the secondary transfer portion. Similar to the image formation to the above-described front surface (first side), an image is formed on the rear surface (second side) of the recording material S. The recording material S on which the image has been formed on both surfaces is discharged onto the discharging tray 162 by the discharge reverse rollers 161.

<Toner Supply from Toner Bottle T>

Referring to FIG. 2, the toner supply of yellow (Y) from a toner bottle TY to the developing apparatus 114Y will be described. Toner bottles TY, TM, TC, and TK are containers that contain toners. Note that, since the toner bottles TY, TM, TC, and TK have the same structures, the subscripts Y, M, C and K of the reference numerals will be omitted in the following description. In the image forming process, a toner image is formed by consuming the toner contained in the developing apparatus 114. Accordingly, whenever the image forming process is performed, the toner amount in the developing apparatus 114 is decreased. As illustrated in FIG. 2, an inductance sensor 120 that detects the amount of the toner contained in the developing apparatus 114 is arranged to the developing apparatus 114. The inductance sensor 120 detects the magnetic permeability of a developer contained in the developing apparatus 114, and outputs a signal according to the ratio of the toner in the developer. The inductance sensor 120 corresponds to a detector that detects the amount of the developer accumulated in the developing apparatus 114. The inductance sensor 120 of the developing apparatus 114 is electrically connected to a controller 1100 as a control unit provided in the image forming apparatus 101. The controller 1100 will be described later by using FIG. 4. The inductance sensor 120 transmits the signal according to the ratio of the toner in the developer in the developing apparatus 114 to the controller 1100. The controller 1100 detects the amount of the toner in the developer contained in the developing apparatus 114, which is a containing portion containing the developer, based on an output value of the signal from the inductance sensor 120.

Figure 4:
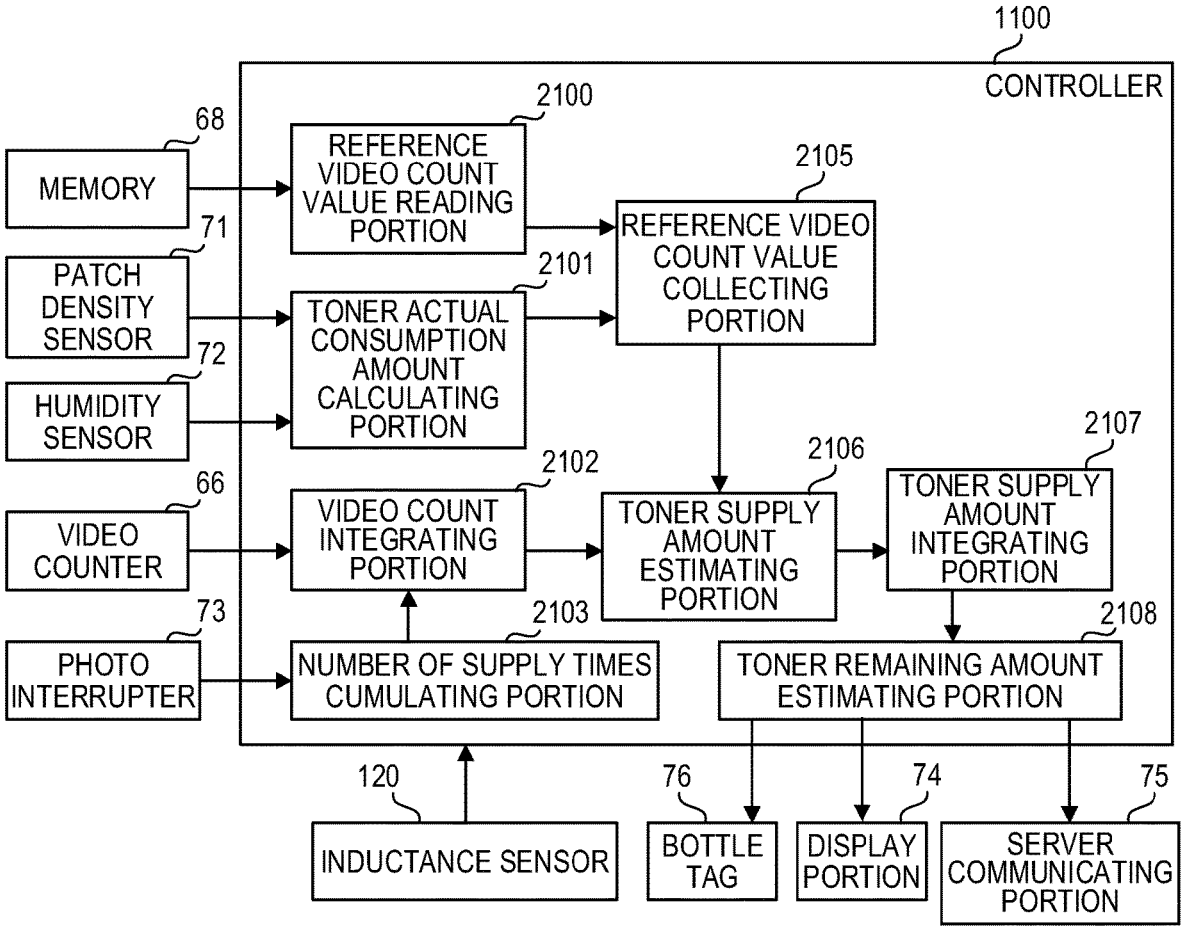
FIG. 4 is a block diagram illustrating the electric configuration of the image forming apparatus related to toner remaining amount estimation in a toner bottle.

The developer contained in the developing apparatus 114 includes a carrier having magnetism, and a toner. Since the ratio of the carrier in the developer is decreased when the ratio of the toner (hereinafter referred to as the toner concentration) in the developer in the developing apparatus 114 is increased, the output value of the inductance sensor 120 is decreased. On the other hand, since the ratio of the carrier in the developer is increased when the toner concentration is decreased, the output value of the inductance sensor 120 is increased. That is, the inductance sensor 120 detects the ratio of the toner in the developer contained in the developing apparatus 114, and outputs the signal according to the detected ratio to the controller 1100. The controller 1100 is electrically connected to a video counter 66, as illustrated in FIG. 4 described later. The video counter 66 calculates the sum of the concentration (gradation level) for each pixel included in an image for one page, based on the input image data. The sum of the concentration for each pixel calculated by the video counter 66 (hereinafter referred to as the video count value) corresponds to the consumption amount of the toner (hereinafter referred to as the toner consumption amount) consumed from the developing apparatus 114 by forming a one-page toner image included in the image data. The video count value is an example of information representing the usage conditions of the image forming apparatus 101. Note that, since the method of obtaining the video count value is a known technology, a description will be omitted.

The controller 1100 outputs a supply instruction for performing toner supply from the toner bottle T to the developing apparatus 114, when the toner consumption amount calculated from the output value (detection result) of the inductance sensor 120 and the video count value exceeds a predetermined threshold value. Note that the controller 1100 may also be configured to implement feedback control based on the toner supply amount, so that the toner concentration in the developing apparatus 114 reaches a target concentration. According to the supply instruction from the controller 1100, a toner is supplied to the developing apparatus 114 from the toner bottle T as the container via a toner supply route 121 connected to the developing apparatus 114. The replaceable toner bottle T is configured to be attached to and detached from a body 101*a* of the image forming apparatus 101. When the toner bottle T is installed to a bottle mount 124 as a mount portion provided in the image forming apparatus 101, a supply opening shutter (not shown) provided in a supply opening (discharge opening) 122 of the toner bottle T is opened. A spiral toner conveying portion (not shown) is formed in the toner bottle T. When the supply instruction is output from the controller 1100, the toner bottle T is rotated by a motor (not shown), and the toner in the toner bottle T is conveyed to the supply opening 122 by the spiral toner conveying portion (not shown). Further, a contraction operation of the toner bottle T is performed according to the rotation operation of the toner bottle T. The toner conveyed close to the supply opening 122 by the toner conveying portion (not shown) is discharged through the supply opening 122 by pumping following the contraction operation of the toner bottle T, and is supplied to a hopper 123 through the bottle mount 124. The toner is supplied to the developing apparatus 114 through the toner supply route 121 from the hopper 123. The controller 1100 and the motor (not shown) function as a supply unit that supplies the toner from the toner bottle T to the developing apparatus 114.

Since the toner consumed in the developing apparatus 114 is supplied from the toner bottle T, the toner in the toner bottle T runs out by continuing the image forming process. Since the toner bottle T is removably attached to the image forming apparatus 101, the toner bottle T whose toner has run out is replaced with a new toner bottle T containing the toner. Accordingly, the image forming apparatus 101 can continue the image forming process.

Figure 3:
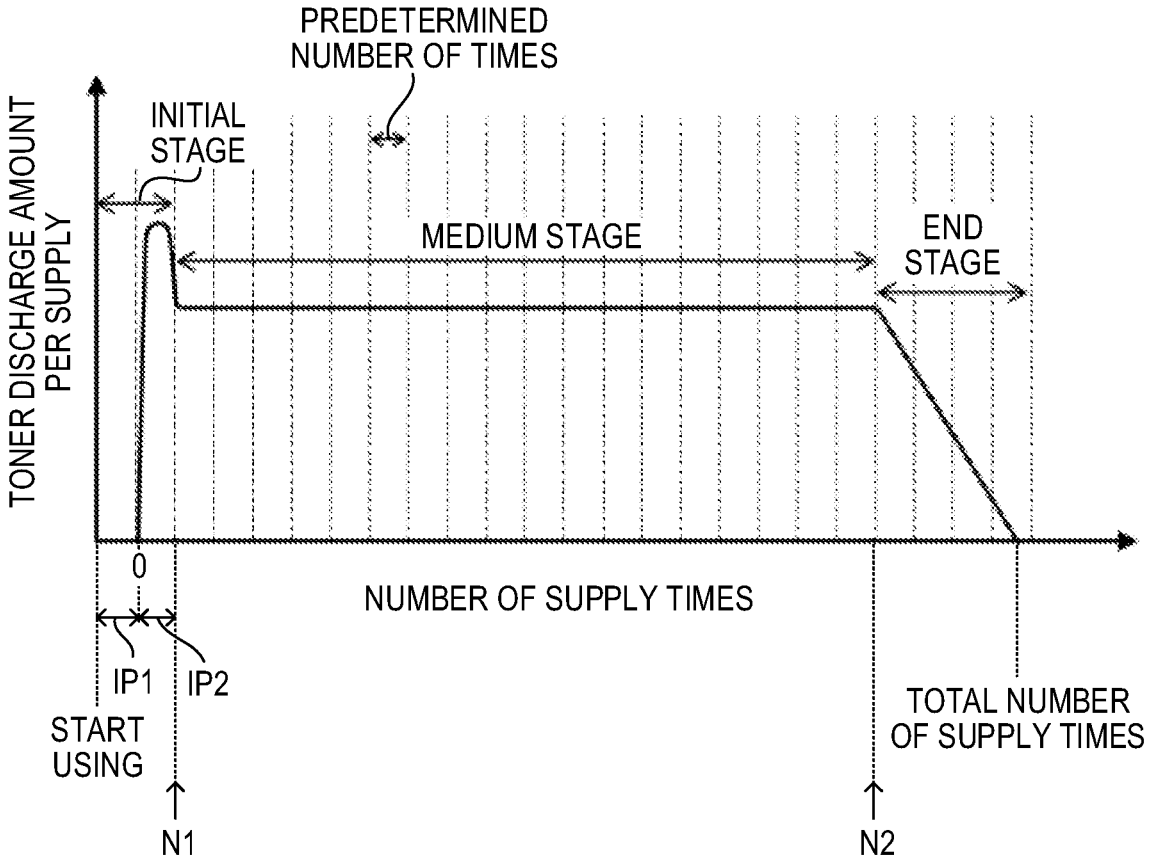
FIG. 3 is a diagram illustrating the change in the toner discharge amount per one supply with respect to the number of supply times.

Using FIG. 3, the discharge amount of the toner (hereinafter referred to as the toner discharge amount) discharged from the toner bottle T will be described. FIG. 3 is a diagram illustrating the change in the toner discharge amount per one supply with respect to the number of supply times. The toner discharge amount per one supply by pumping following the contraction operation of the toner bottle T is different in the following three stages. In the initial stage immediately after the use of the toner bottle T is started, the toner discharge amount per one supply will be in an unstable state where the toner discharge amount is unstable. In a medium stage after the initial stage, the toner discharge amount per one supply will be in a stable state where the toner discharge amount is stable. In the end stage in which the toner remaining amount in the toner bottle T is decreased and the toner bottle T becomes close to empty, the toner discharge amount per 1 supply will be in a decreasing state where the toner discharge amount is gradually decreased.

The toner in a new toner bottle T may be compacted near the supply opening 122 by the vibration at the time of transportation of the toner bottle T. Even if the toner bottle T starts pumping in the initial stage when the use of the new toner bottle T is started, since the compacted toner blocks the supply opening 122, the toner is not discharged from the toner bottle T in the first several times of pumping. That is, as illustrated in FIG. 3, even if the supply operation is performed in a period IP1 immediately after the use is started of the initial stage, the toner discharge amount per one supply is zero.

When the compacted toner blocking the supply opening 12 collapses, the toner filled in the whole area of the toner bottle T is conveyed toward the supply opening 122 all at once. Thus, more toner than in the stable state may be discharged. That is, as illustrated in FIG. 3, in a period IP2 of the initial stages, the toner discharge amount per one supply is greater than the toner discharge amount per one supply in the stable state.

In the medium stage, by providing a constant pressure by pumping of the toner bottle T to the toner collected near the supply opening 122 in the toner bottle T, the stable state is achieved where the toner discharge amount per one supply is constant, and stable discharging of the toner is enabled. In the end stage, the toner remaining amount in the toner bottle T has been decreased. In the end stage, even if the constant pressure is provided by pumping of the toner bottle T to the toner collected near the supply opening 122 in the toner bottle T, the ratio that the air in the toner bottle T is discharged in addition to the toner according to the toner remaining amount becomes high. Accordingly, the end stage will be in the decreasing state where the toner discharge amount per one supply is gradually decreased.

<Toner Supply Amount Estimation Method>

Next, referring to FIG. 4, FIG. 5, FIG. 6, and FIG. 7, a method will be described that estimates the toner remaining amount in the toner bottle T by estimating a toner supply amount by using the cumulative number of supply times in a period of a predetermined number of times of the supply operation, and the integrated value of the video count value informed in the period. FIG. 4 is a block diagram illustrating the electric configuration of the image forming apparatus 101 related to the toner remaining amount estimation in the toner bottle T. The controller 1100 is electrically connected to a memory 68, a patch concentration sensor 71, a moisture sensor 72, the video counter 66, and a photo interrupter 73. The controller 1100 is further electrically connected to a bottle tag 76, a display portion 74, and a server communication portion 75. The controller 1100 includes a reference video count value reading portion 2100, a toner real consumption amount calculating portion 2101, and a reference video count value correcting portion 2105. The controller 1100 further includes a video count integrating portion 2102, a number of supply times cumulating portion 2103, a toner supply amount estimating portion 2106, a toner supply amount integrating portion 2107, and a toner remaining amount estimating portion 2108.

Figure 5:
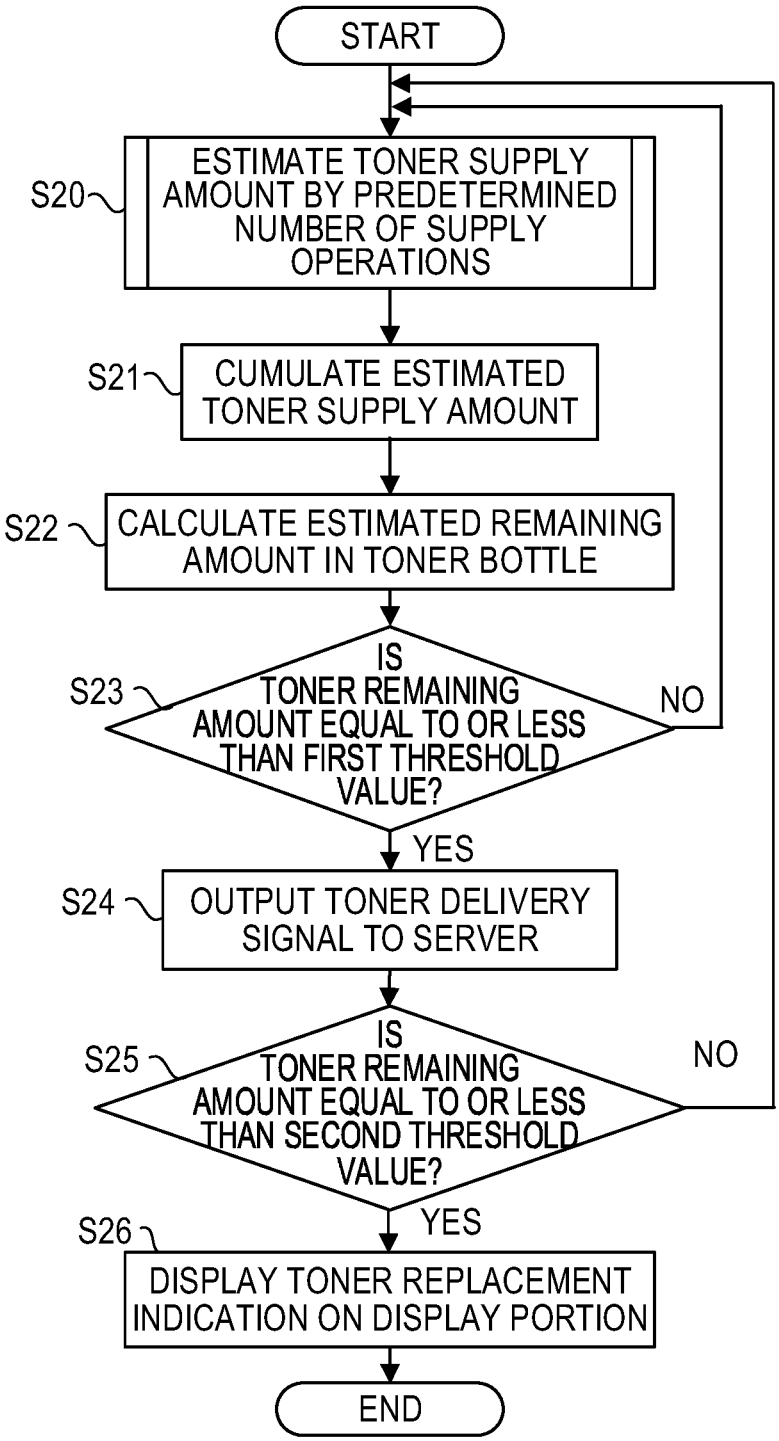
FIG. 5 is a flowchart illustrating a toner remaining amount estimation operation performed by a controller.
Figure 6:
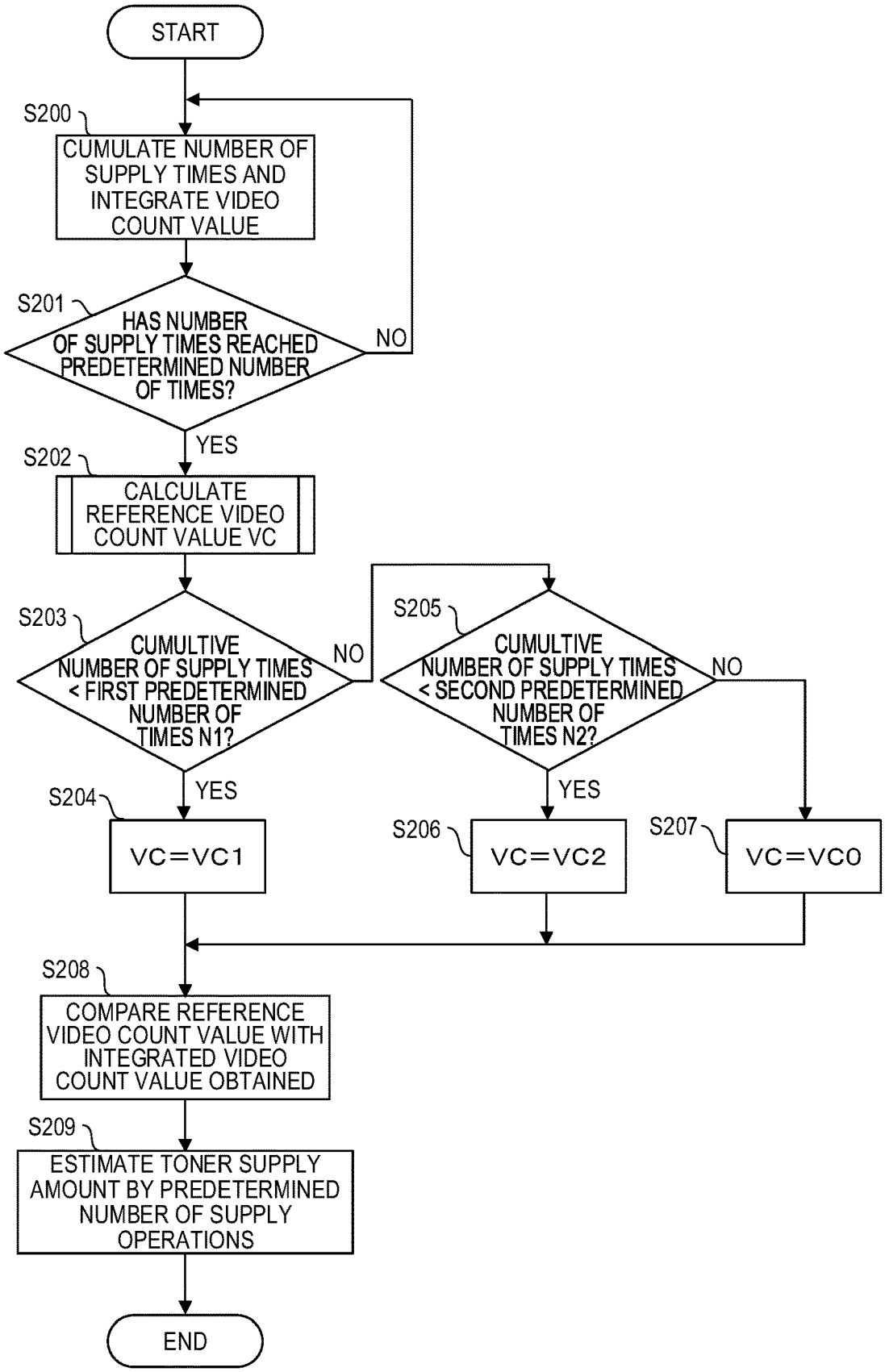
FIG. 6 is a flowchart illustrating a toner supply amount estimation operation of Embodiment 1.

FIG. 5 is a flowchart illustrating a toner remaining amount estimation operation performed by the controller 1100. When the toner remaining amount estimation operation is started, the controller 1100 estimates the toner supply amount (developer supply amount) by a predetermined number of times of the supply operation, so as to estimate the toner remaining amount in the toner bottle T (S20). Referring to FIG. 6, a subroutine of S20 that estimates the toner supply amount by the predetermined number of times of the supply amount will be described. FIG. 6 is a flowchart illustrating the toner supply amount estimation operation in Embodiment 1. When the toner supply amount estimation operation is started, the controller 1100 cumulates the number of supply times (number of times of execution) based on a detection signal from the photo interrupter 73 (S200). The photo interrupter 73 detects a flag (not shown) provided in the rotating toner bottle T, and outputs the detection signal to the controller 1100. The detection signal of the photo interrupter 73 is input to the number of supply times cumulating portion 2103 of the controller 1100. The number of supply times cumulating portion 2103 derives the number of supply times by deriving the number of times of rotation of the toner bottle T based on the detection signal of the photo interrupter 73, and cumulates the number of supply times. That is, the number of supply times cumulating portion 2103 functions as a count unit that counts the number of times of the supply operation from the toner bottle T attached to the bottle mount 124. The number of supply times cumulating portion 2103 calculates the number of supply times for determining whether or not the predetermined number of times of the supply operation has been performed, and the cumulative number of supply times obtained by cumulating the supply operations since the use of the toner bottle T is started. Further, the controller 1100 integrates the video count values from the video counter 66 (S200). The video count value from the video counter 66 is input to the video count integrating portion 2102 of the controller 1100. The video count integrating portion 2102 integrates the video count values, and generates an integrated video count value (statistics value).

The controller 1100 determines whether or not the number of supply times has reached the predetermined number of times (S201). In the present embodiment, although the predetermined number of times is set to 10, the predetermined number of times is a constant that can be arbitrarily set. When the number of supply times has not reached the predetermined number of times (NO in S201), the processing returns to S200, and the controller 1100 continues the cumulating processing of the number of supply times and the integration processing of the video count value until the number of supply times reaches the predetermined number of times. When the number of supply times has reached the predetermined number of times (YES in S201), the controller 1100 calculates the reference video count value (reference value) VC (S202).

Figure 7:
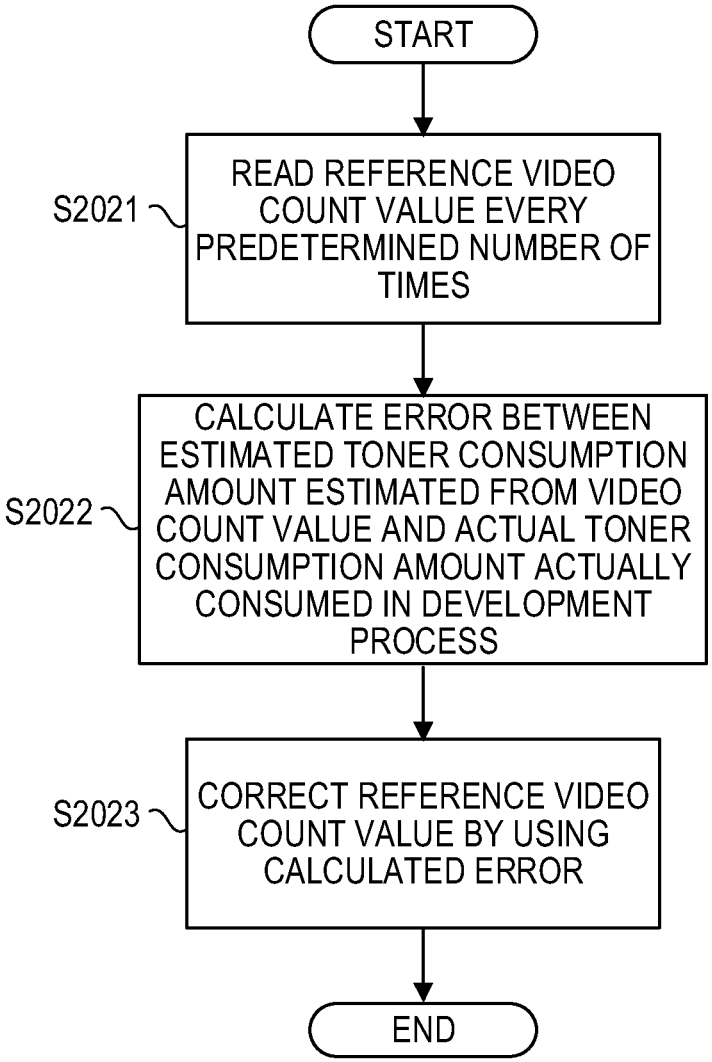
FIG. 7 is a flowchart illustrating a calculation operation of a reference video count value.

Referring to FIG. 7, a subroutine for calculation of the reference video count value VC in S202 of FIG. 6 will be described. FIG. 7 is a flowchart illustrating the calculation operation of the reference video count value VC. In the present embodiment, the reference video count value (reference value) VC is the name of the integrated video count value per ten supply operations. When the calculation operation of the reference video count value VC is started, the reference video count value reading portion 2100 of the controller 1100 reads the reference video count value VC from the memory 68 whenever the number of supply times reaches the predetermined number of times (S2021). Since the predetermined number of times is set to 10 in the present embodiment, whenever the number of supply times reaches ten times, the reference video count value VC is read from the memory 68. Next, the reference video count value correcting portion 2105 of the controller 1100 calculates the error between the estimated toner consumption amount estimated from the video count value, and the real toner consumption amount actually consumed in a developing process (S2022). The real toner consumption amount is calculated by the toner real consumption amount calculating portion 2101 from the information obtained from the detection results of the patch concentration sensor 71 and the moisture sensor 72. The detection result of the moisture sensor 72 is an example representing the information on the usage environment of the image forming apparatus 101. The error between the estimated toner consumption amount and the real toner consumption amount is generated due to the environmental change and the variation in the image forming apparatus 101. Finally, the reference video count value correcting portion 2105 of the controller 1100 corrects the reference video count value VC read in S2021 by using the error calculated in S2022 (S2023). The controller 1100 ends the calculation operation of the reference video count value VC, and the processing returns to the flowchart of FIG. 6.

The calculation of the reference video count value VC in S202 will be specifically described. In the present embodiment, based on the center value of the toner supply amount per one supply operation experimentally derived in advance, a representative value is used that a 2.0 g toner is supplied to the developing apparatus 114 in ten toner supply operations. Additionally, a representative value is used that a 0.4 g toner is consumed for image formation, when the video count value of 500 dec is informed. dec is the abbreviation for decimal (decimal number). Measurement of the center value of the toner supply amount per one supply operation is performed in the medium stage of the number of supply times where the toner discharge amount per one supply from the toner bottle T is stable. The reference video count value VC in the medium stage of the number of supply times is used as the reference value of the toner discharge amount per one supply in each of the initial stage, the medium stage, and the end stage of the number of supply times. Therefore, let the reference video count value VC in the medium stage be a medium-stage reference video count value VC0.

First, step S2021, which reads the reference video count value VC from the memory 68 whenever the number of supply times reaches the predetermined number of times, will be specifically described. The representative value 2.0 g of the toner supply amount supplied to the developing apparatus 114 in ten toner supply operations corresponds to the video count value of $500 \times 2.0/0.4 = 2500$ dec, when the representative value that a 0.4 g toner is consumed per video count value of 500 dec. The memory 68 stores in advance the video count value 2500 dec as the medium-stage reference video count value VC0. The medium-stage reference video count value VC0 is read from the memory 68 for every predetermined number of times (ten times in the present embodiment) of the supply operations, and is used for the later processing. The calculation formula VC=VC0 is a calculation formula (determination condition) for estimating the toner usage amount per predetermined number of times of the supply operation in the medium stage.

Next, step S2022, which calculates the error between the estimated toner consumption amount calculated from the video count value, and the real toner consumption amount, will be specifically described. For concentration adjustment, the concentration of the toner image formed on the surface of the intermediate transfer belt 1 is detected by using the patch concentration sensor 71 as a toner amount sensor. The patch concentration sensor 71 includes a light-emitting portion with an LED (light emitting diode), and a light receiving portion with a PD (photodiode). For example, it is assumed that, when the video count value of 10 dec is informed in order to form a toner image, the difference between the real toner consumption amount based on the detection result of the patch concentration sensor 71 and the estimated toner consumption amount as a target value is −0.8 mg. The −0.8 mg difference means that the toner amount actually consumed is less compared to the nominal toner consumption amount. For example, when the video count value of 500 dec is informed, the difference between the real toner consumption amount and the estimated toner consumption amount is calculated to be −0.04 g by using the above-described actual measurement result.

Finally, step S2023, which corrects the reference video count value VC read from the memory 68, by using the difference calculated as the error, will be specifically described. The reference video count value correcting portion 2105 changes the above-described representative value that the 0.4 g toner is consumed per video count value of 500 dec into 0.36 g, by using −0.04 g calculated in S2022. The reference video count value correcting portion 2105 calculates the reference video count value VC by using the changed representative value 0.36 g. The reference video count value VC is calculated as 500×2.0/0.36=2778 dec. The reference video count value correcting portion 2105 corrects the reference video count value VC from 2500 dec to 2778 dec.

Additionally, a method of using the detection result of the humidity in the developing apparatus 114 will be described as another unit for correcting the reference video count value VC in S2023. Generally, when the humidity in the developing apparatus 114 changes, a change occurs in the charging amount of the toner inside the developing apparatus 114, and the toner amount consumed in the developing process changes. That is, even in the developing process for which the same video count value has been informed, when the humidity is different, the consumed toner amount changes. In order to reduce the influence of the humidity, the error in the toner consumption amount when a predetermined video count value is informed is calculated from the relationship of the error in the nominal toner consumption amount with respect to the humidity in the developing apparatus 114 stored in advance in the memory 68, and the humidity actually measured. The reference video count value VC is corrected by using the calculated error in the toner consumption amount.

The above-described method using the detection result of the humidity will be specifically described. The memory 68 stores in advance a table representing the error in the nominal toner consumption amount with respect to the humidity in the developing apparatus 114. The error in the nominal toner consumption amount is the toner consumption amount at the time when a unit video count value is informed. For example, it is assumed that a table is stored in advance in the memory 68, the table indicating the relationship that, in a case where the ambient temperature of the image forming apparatus 101 is 23° C. the error is 0 mg when the humidity is 0%, and the error is −0.04 mg when the humidity is 30%. Now, when the humidity in the developing apparatus 114 actually measured by the moisture sensor 72 is 30%, the error in the toner consumption amount with respect to the unit video count value is −0.04 mg. Accordingly, the error in the toner consumption amount in the developing process when the video count value of 500 dec is informed is 500×(−0.04)=−20 mg=−0.02 g. The reference video count value VC is corrected in a manner similar to the method of correcting the reference video count value VC by using the above-described detection result of the patch concentration sensor 71. The representative value of the toner consumption amount when the video count value of 500 dec is informed is calculated as 0.4-0.02=0.38 g. Thus, the reference video count value is calculated as 500×2.0/0.38=2632 dec. The reference video count value correcting portion 2105 corrects the reference video count value VC from 2500 dec to 2632 dec.

After the calculation operation of the reference video count value VC ends, the processing returns to step S202 of FIG. 6. According to the above-described embodiment, the reference video count value VC is corrected to 2778 dec in S202.

As described above, the toner discharge amount discharged from the toner bottle T by one supply operation is different in the initial stage, the medium stage, and the end stage of the number of supply times. Therefore, the reference video count value VC is set according to the stage of the number of supply times. The stage of the number of supply times is determined for each toner bottle T based on the cumulative number of supply times obtained in S200. In the initial stage of the number of supply times of the toner illustrated in FIG. 3, as mentioned above, in the period IP1 immediately after the use of the toner bottle T is started, the toner may not be discharged from the toner bottle T even if the supply operation is being performed, and the toner may not be supplied to the developing apparatus 114. Therefore, when it is detected that a new toner bottle T is attached to the body 101*a* of the image forming apparatus 101, the controller 1100 determines whether or not the output of the inductance sensor 120 changes in connection with the supply operation. When the output of the inductance sensor 120 does not change, the controller 1100 determines that the toner has not been discharged from the toner bottle T even though the supply operation has been performed. The number of supply times cumulating portion 2103 of the controller 1100 does not add, to the cumulative number of supply times, the number of times of the supply operation performed during the period until the output of the inductance sensor 120 changes after the new toner bottle T is attached to the body 101*a* of the image forming apparatus 101. After the output of the inductance sensor 120 changes, the number of supply times cumulating portion 2103 calculates the cumulative number of supply times based on the detection signal of the photo interrupter 73.

The controller 1100 determines whether or not the cumulative number of supply times is smaller than a first predetermined number of times N1 (S203). The first predetermined number of times N1 is derived in advance by experiments as the number of supply times until the toner discharge amount discharged by one supply operation is in a stable state since the cumulation of the number of supply times is started, and is stored in one of the memory 68 and the bottle tag 76. Additionally, the ratio of the average value of the toner discharge amount in the medium stage, which is a stable state, with respect to the average value of the toner discharge amount in the initial stage is calculated in advance, and an initial-stage reference video count value VC1 is calculated by multiplying the medium-stage reference video count value VC0 by a reciprocal number k1 of the ratio. The initial-stage reference video count value VC1 is represented by the following formula.

$$VC1=k1\times VC0$$

When the cumulative number of supply times is smaller than the first predetermined number of times N1 (YES in S203), the controller 1100 sets the initial-stage reference video count value VC1 to the reference video count value VC (S204), and proceeds the processing to S208. The calculation formula VC=VC1 is a calculation formula (determination condition) for estimating the toner usage amount per predetermined number of times of the supply operation in the initial stage. On the other hand, when the cumulative number of supply times is equal to or more than the first predetermined number of times (equal to or more than N1) (NO in S203), the controller 1100 determines whether or not the cumulative number of supply times is larger than a second predetermined number of times N2 (S205). As described above, in the end stage of the number of supply times, the toner discharge amount is decreased with an increase in the cumulative number of supply times. The second predetermined number of times N2 is derived in advance by experiments as the number of supply times until the toner discharge amount is switched from the stable state to the decreasing state since the cumulation of the number of supply times is started, and is stored in one of the memory 68 and the bottle tag 76. When the cumulative number of supply times becomes larger than the second predetermined number of times N2, it is determined that a transition has been made from the medium stage to the end stage.

Regarding the decrease ratio of the toner discharge amount in the end stage of the number of supply times, the average of the decreasing amount of the toner discharge amount per one supply is derived by experiments, and the decreasing amount of the reference video count value VC per one supply is derived from a ratio with respect to the average value of the toner discharge amount in the medium stage, which is a stable state. An end-stage reference video count value VC2 is derived by subtracting, from the reference video count value VC, a value obtained by multiplying this decreasing amount by the number of supply times after a transition is made to the end stage. However, when the cumulative number of supply times is increased by the variation due to the individual differences of toner bottles T, the end-stage reference video count value VC2 may reach a negative value. Accordingly, a minimum end-stage reference video count value is set. When the cumulative number of supply times is represented by SCn, in a case where the predetermined number of times is 10, the end-stage reference video count value VC2 during the cumulative number of supply times from $SCn_{-10}$ to SCn is calculated. Let the reciprocal number of the ratio between the decreasing amount of the toner discharge amount per one supply and the toner discharge amount in the medium stage be k2. Let the number of supply times that makes a transition to the end stage be SCe. The end-stage reference video count value VC2 by the predetermined number of times of the supply operation in the end stage of the number of supply times is represented by the following formula.

$$VC2=\sum_{i=1}^{10}((1-(SCe-SCn_{-10})\times k2)\times VC0)/10$$

When the cumulative number of supply times is larger than the second predetermined number of times N2 (YES in S205), the controller 1100 sets the end-stage reference video count value VC2 to the reference video count value VC (S206), and proceeds the processing to S208. The calculation formula VC=VC2 is a calculation formula (determination condition) that estimates the toner usage amount per predetermined number of times of the supply operation in the end stage. On the other hand, when the cumulative number of supply times is equal to or less than the second predetermined number of times (equal to or less than N2) (NO in S205), the controller 1100 sets the medium-stage reference video count value VC0 to the reference video count value VC (S207), and proceeds the processing to S208.

As described above, the initial-stage reference video count value VC1, the medium-stage reference video count value VC0, and the end-stage reference video count value VC2 are properly used as the reference video count value VC, according to the initial stage, the medium stage, and the end stage of the number of supply times. Accordingly, the toner supply amount estimation operation in consideration of the change in the toner discharge amount with respect to the number of supply times can be performed.

The toner supply amount estimating portion 2106 of the controller 1100 compares the reference video count values VC calculated in S202 with the integration video count value obtained in S200 (S208). In the present embodiment, the obtained integration video count value is an integrated value of the video count values that will be informed by the time the supply operation is performed ten times. The toner supply amount estimating portion 2106 estimates the toner supply amount by a predetermined number of times of the supply operation from the magnitude relationship of the integration video count value integrated until the supply operation is performed ten times in S200 with respect to the reference video count value VC calculated in S202 (S209).

The above-described steps S208 and S209 will be specifically described. For example, suppose that the integration video count value obtained in S200 is 3000 dec. The integration video count value 3000 dec is larger than the reference video count value VC 2778 dec calculated in S202. When the integration video count value is larger than the reference video count value VC, by the time the supply operation is performed ten times, a video count value larger than the reference video count value VC will be informed. Since the integration video count value is larger than the reference video count value VC, under ordinary circumstances, more than ten supply operations are required. However, since ten supply operations have sufficed, it is recognized that the toner supply amount per one supply operation is high. That is, it is recognized that the toner amount supplied by these ten supply operations is greater than 2.0 g, which is the representative value of the toner supplied by ten supply operations. The toner supply amount of these ten supply operations can be calculated as 2.0×3000/2778=2.16 g.

Conversely, suppose that the integration video count value obtained in S200 is 2500 dec. The integration video count value 2500 dec is smaller than the reference video count value VC 2778 dec calculated in S202. When the integration video count value is smaller than the reference video count value VC, by the time the supply operation is performed ten times, a video count value smaller than the reference video count value VC will be informed. Since the integration video count value is smaller than the reference video count value VC, under ordinary circumstances, less than ten times of the supply operations suffice. However, since ten supply operations have been required, it is recognized that the toner supply amount per one supply operation is low. That is, it is recognized that the toner amount supplied by these ten supply operations is less than 2.0 g, which is the representative value of the toner supplied by ten supply operations. The toner supply amount for these ten times can be calculated as 2.0×2500/2778=1.8 g.

The toner supply amount for a predetermined number of times is estimated by the above-described calculation. The controller 1100 ends the toner supply amount estimation operation illustrated in FIG. 6, and ends S20 in FIG. 5.

<Toner Bottle Remaining Amount Estimation Method>

Next, in order to obtain the toner consumption amount in the toner bottle T that has been consumed up to now, the toner supply amount integrating portion 2107 of the controller 1100 integrates the toner supply amount estimated in S20 (S21). The toner supply amount integrated in S21 corresponds to the amount of the toner consumed (consumption amount) from the toner bottle T. The toner remaining amount estimating portion 2108 calculates a current value (estimated value) of the toner remaining amount in the toner bottle T by subtracting the integrated value of the estimated toner supply amount obtained in S21 from an initial-stage filling amount of the toner bottle T (S22). Here, the controller 1100 functions as a determination unit that determines the toner remaining amount of the developer in the developing apparatus 114 from the video count value based on an estimation calculation formula corresponding to the cumulative number of supply times. The controller 1100 determines whether or not the toner remaining amount obtained in S22 is equal to or less than a first threshold value (for example, 30 g) (S23). When the toner remaining amount is more than the first threshold value (NO in S23), the processing returns to S20, and the controller 1100 continues estimation of the toner supply amount. When the toner remaining amount is equal to or less than the first threshold value (YES in S23), the controller 1100 outputs a delivery signal of the toner bottle T to a server (external apparatus) (S24).

Thereafter, the controller 1100 determines whether or not the toner remaining amount obtained in S22 is equal to or less than the second threshold value (for example, 10 g) (S25). When the toner remaining amount is more than the second threshold value (NO in S25), the processing returns to S20, and the controller 1100 continues estimation of the toner supply amount. When the toner remaining amount is equal to or less than the second threshold value (YES in S25), the controller 1100 displays a toner replacement display on the display portion 74 (S26), and informs a user that the toner bottle T needs to be replaced. The controller 1100 ends the toner remaining amount estimation operation.

In this manner, more accurate toner remaining amount estimation can be performed through a period until the toner bottle T becomes empty since the use of the toner bottle T is started, by changing the estimation calculation formula of the toner discharge amount based on the cumulative number of supply times. The toner remaining amount in the toner bottle T can be estimated based on the information obtained from the image forming apparatus 101, without providing an exclusive toner remaining amount detector for detecting the toner remaining amount in the toner bottle T. Additionally, the necessity for replacing the toner bottle T can be informed to the user at the optimum timing by outputting the delivery signal of the toner bottle T to the server at the optimum timing. According to the present embodiment, regardless of the difference in the toner discharge amount per one supply due to the individual differences of the toner bottles T, the toner remaining amount in the toner bottle T can be accurately estimated.

Note that the toner remaining amount calculated in S22 is stored in the bottle tag 76, which is a memory mounted in the toner bottle T. This is for storing the initial value for the toner remaining amount estimation at the time when the toner bottle T is removed by the user in the state where the toner sufficiently remains in the toner bottle T, and the same toner bottle T is attached again. Here, the controller 1100 functions as a reporting unit that informs the toner remaining amount. Additionally, when it is detected that a new toner bottle T is attached, the initial value of the toner remaining amount in the toner bottle T stored in advance in the bottle tag 76 may be used, or the initial value stored in the memory 68 of the image forming apparatus 101 may be used.

The toner remaining amount estimation operation illustrated in FIG. 5 is performed for every predetermined number of times of supply operations. In the present embodiment, although the predetermined number of times is set to ten, the toner remaining amount estimation operation may be performed for each one supply operation. Additionally, the toner remaining amount estimation operation is performed for each toner bottle T of each color. That is, the toner remaining amount estimation operation is independently performed for each of the toner bottle TY for yellow, the toner bottle TM for magenta, the toner bottle TC for cyan, and the toner bottle TK for black.

According to the present embodiment, the remaining amount of the toner in the toner bottle can be determined from image data, based on the determination condition corresponding to the number of times of supply operation.

Embodiment 2

Next, Embodiment 2 will be described. In Embodiment 2, the same reference numerals are given to the same structures as those in Embodiment 1, and a description will be omitted. Since the image forming apparatus 101, the image forming process, the toner supply from the toner bottle T, and the electric configuration of the image forming apparatus 101 in Embodiment 2 are the same as those in Embodiment 1, a description will be omitted. In the toner supply amount estimation method, Embodiment 1 determines the initial stage, the medium stage, and the end stage of the number of supply times based on the cumulative number of supply times. That is, in Embodiment 1, the cumulative number of supply times is used as a parameter about the usage conditions of the toner bottle T. On the other hand, Embodiment 2 determines the initial stage, the medium stage, and the end stage of the number of supply times based on the toner remaining amount. That is, in Embodiment 2, the toner remaining amount derived in the previous time is used as the parameter about the usage conditions of the toner bottle T. The differences from Embodiment 1 will be mainly described below.

Figure 8:
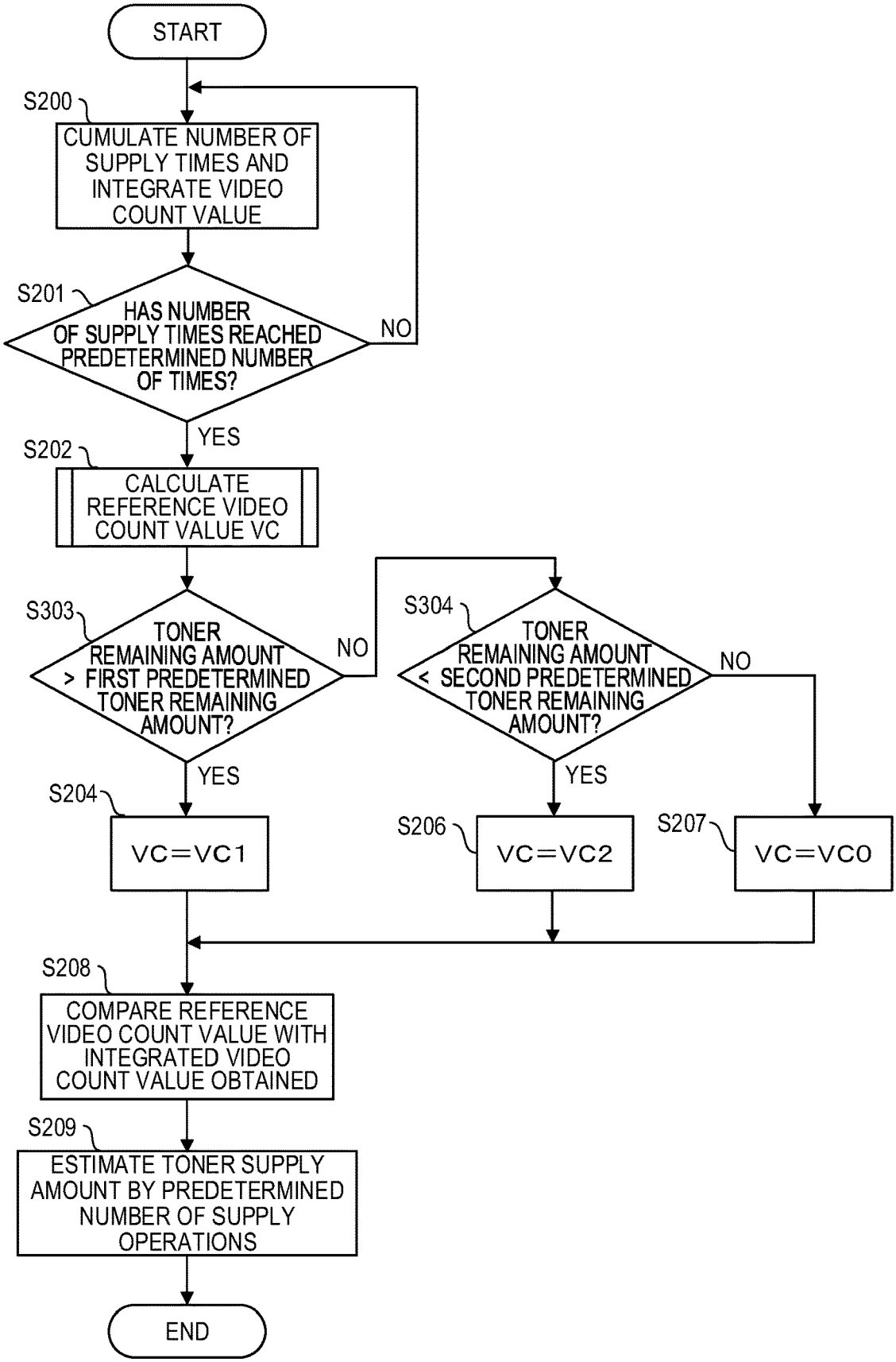
FIG. 8 is a flowchart illustrating the toner supply amount estimation operation of Embodiment 2.

FIG. 8 is a flowchart illustrating the toner supply amount estimation operation of Embodiment 2. The same reference numerals are given to the same steps as those in the toner supply amount estimation operation of Embodiment 1 illustrated in FIG. 6, and a description will be omitted. Since S200 to S202 are the same as those of Embodiment 1, a description will be omitted. After calculating the reference video count value VC in S202, the controller 1100 determined whether or not the toner remaining amount is greater than a first predetermined toner remaining amount (S303). The first predetermined toner remaining amount is a toner remaining amount that remains in the toner bottle T when the initial stage, which is an unstable state, ends and the medium stage, which is a stable state, begins, and is derived in advance by experiments and stored in one of the memory 68 and the bottle tag 76.

When the toner remaining amount is greater than the first predetermined toner remaining amount (predetermined amount) (YES in S303), the controller 1100 sets the initial-stage reference video count value VC1 to the reference video count value VC (S204), and proceeds the processing to S208. The calculation formula VC=VC1 is a calculation formula (a second determination condition) for estimating the toner usage amount per predetermined number of times of the supply operation in the initial stage. When the toner remaining amount determined based on VC=VC0 (a first determination condition) is greater than the first predetermined toner remaining amount, the controller 1100 redetermines the toner remaining amount from image data based on VC=VC1 (the second determination condition), which is different from VC=VC0. On the other hand, when the toner remaining amount is equal to or less than the first predetermined toner remaining amount (NO in S303), the controller 1100 determines whether or not the toner remaining amount is less than the second predetermined toner remaining amount (S304). The second predetermined toner remaining amount is a toner remaining amount that remains in the toner bottle T when the medium stage, which is a stable state, ends and the end stage, which is a decreasing state, begins, and is derived in advance by experiments and stored in one of the memory 68 and the bottle tag 76.

When the toner remaining amount is less than the second predetermined toner remaining amount (YES in S304), the controller 1100 sets the end-stage reference video count value VC2 to the reference video count value VC (S206), and proceeds the processing to S208. The calculation formula VC=VC2 is a calculation formula (a third determination condition) for estimating the toner usage amount per a predetermined number of times of the supply operation in the end stage. On the other hand, when the toner remaining amount is equal to or more than the second predetermined toner remaining amount (NO in S304), the controller 1100 sets the medium-stage reference video count value VC0 to the reference video count value VC (S207), and proceeds the processing to S208. The calculation formula VC=VC0 is a calculation formula (the first determination condition) for estimating the toner usage amount per a predetermined number of times of the supply operation in the medium stage. Since S208 and S209 are the same as those of Embodiment 1, a description will be omitted.

In this manner, more accurate toner remaining amount estimation can be performed through a period until the toner bottle T becomes empty since the use of the toner bottle T is started, by changing the estimation calculation formula of the toner discharge amount based on the estimated toner remaining amount. The toner remaining amount in the toner bottle T can be estimated based on the information obtained from the image forming apparatus 101, without providing an exclusive toner remaining amount detector for detecting the toner remaining amount in the toner bottle T. According to the present embodiment, regardless of the difference in the toner discharge amount per one supply due to the individual differences of the toner bottles T, the toner remaining amount in the toner bottle T can be accurately estimated.

According to the present embodiment, the remaining amount of the toner in the toner bottle can be determined from image data, based on the determination condition changed based on the toner remaining amount.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-211212, filed Nov. 9, 2018, which is hereby incorporated by reference herein in its entirety.

What is claimed is:

1. An image forming apparatus comprising:

an image forming unit configured to form an image based on image data, wherein the image forming unit has a photosensitive member, a charging unit that charges the photosensitive member, an exposing unit that exposes the photosensitive member charged by the charging unit to form an electrostatic latent image on the photosensitive member, and a developing unit that develops the electrostatic latent image by using a toner;

a mount portion to which a container is mounted, the container containing a toner to be supplied;

a supplying unit configured to supply the toner from the container to the developing unit, and a controller configured to:

perform a supply operation in which the toner is supplied by the supply unit, and determine a remaining amount of the toner in the container mounted to the mount portion, based on a number of times of the supply operation and the image data.

2. The image forming apparatus according to claim 1, wherein the controller transmits a delivery signal to an external apparatus, in a case where the remaining amount of the toner in the container mounted to the mount portion is equal to or less than a first threshold amount.

3. The image forming apparatus according to claim 2, further comprising a display, wherein the display displays a screen for prompting a replacement of the container mounted to the mount portion, in a case where the remaining amount of the toner in the container mounted to the mount portion is equal to or less than a second threshold amount.

4. The image forming apparatus according to claim 1, further comprising a display, wherein the display displays the remaining amount of the toner in the container mounted to the mount portion.

5. The image forming apparatus according to claim 1, wherein the controller generates a determination condition based on the number of times of the supplying operation, and wherein the controller determines the remaining amount of the toner in the container based on the determination condition and the image data.

6. The image forming apparatus according to claim 1, further comprising:

a sensor configured to measure a measurement image formed by the image forming unit, wherein the controller generates a determination condition based on the number of times of the supplying operation and a measurement result of the sensor, and wherein the controller determines the remaining amount of the toner in the container based on the determination condition and the image data.

7. The image forming apparatus according to claim 1, wherein the controller obtains information related to humidity in the developing unit, wherein the controller generates a determination condition based on the number of times of the supplying operation and the information related to humidity in the developing unit, and wherein the controller determines the remaining amount of the toner in the container based on the determination condition and the image data.

8. An information processing apparatus that enables communication with an image forming apparatus that forms an image based on image data, wherein the image forming apparatus includes a photosensitive member, a charging unit configured to charge the photosensitive member, an exposing unit configured to expose the photosensitive member charged by the charging unit to form an electrostatic latent image on the photosensitive member, a developing unit configured to develop the electrostatic latent image by using a toner, a mount portion to which a container containing a toner to be supplied is mounted, and a supplying unit configured to supply the toner from the container mounted to the mount portion to the developing unit, the information processing apparatus comprising:

an obtaining unit configured to obtain a number of times of a supplying operation in which the toner is supplied by the supplying unit; and a controller configured to determine a remaining amount of the toner in the container mounted to the mount portion, based on the number of times of the supplying operation and the image data.

9. The information processing apparatus according to claim 8, wherein the controller generates a determination condition based on the number of times of the supplying operation, and wherein the controller determines the remaining amount of the toner in the container based on the determination condition and the image data.

10. The information processing apparatus according to claim 8, wherein the controller obtains data related to a measurement result of a measurement image by a sensor, the measurement image being formed by the image forming unit, wherein the controller generates a determination condition based on the number of times of the supplying operation and the data, and wherein the controller determines the remaining amount of the toner in the container based on the determination condition and the image data.

11. The information processing apparatus according to claim 8, wherein the controller obtains information related to humidity in the developing unit, wherein the controller generates a determination condition based on the number of times of the supplying operation and the information related to humidity in the developing unit, and wherein the controller determines the remaining amount of the toner in the container based on the determination condition and the image data.

12. The information processing apparatus according to claim 8, wherein the supplying unit rotates the container mounted to the mount portion to supply the toner from the container, and wherein the number of times of the supplying operation corresponds to a rotation number of the container rotated by the supplying unit.

13. The information processing apparatus according to claim 8, wherein the controller transmits a delivery signal to an external apparatus, in a case where the remaining amount of the toner in the container mounted to the mount portion is equal to or less than a first threshold amount.

14. The information processing apparatus according to claim 13, wherein the controller transmits a replacement signal to a display, in a case where the remaining amount of the toner in the container mounted to the mount is equal to or less than a second threshold amount.

* * * * *